United States Patent [19]

Schantz et al.

[11] 4,267,669

[45] May 19, 1981

[54] METHOD AND APPARATUS FOR GRINDING SMALL CUTTING BLADES

[75] Inventors: Spencer C. Schantz, 5880 Anchorage Rd., Oconomowoc, Wis. 53066; Leland A. Rupenthal, Oconomowoc, Wis.

[73] Assignee: Spencer C. Schantz, Oconomowoc, Wis.

[21] Appl. No.: 113,937

[22] Filed: Jan. 21, 1980

[51] Int. Cl.[3] ..... B24B 3/52

[52] U.S. Cl. ..... 51/5 D; 51/92 ND; 51/108 R; 51/218 R; 51/285

[58] Field of Search ..... 51/5 D, 92 BS, 92 ND, 51/108 R, 108 BS, 218 R, 218 T, 237 T, 285

[56] References Cited

U.S. PATENT DOCUMENTS

| | | | |
|---|---|---|---|
| 541,314 | 6/1895 | Carey | 51/108 R |
| 1,508,727 | 9/1924 | Sheehan | 51/237 T |
| 1,781,674 | 11/1930 | Ashworth | 51/218 R |
| 1,888,710 | 11/1932 | Arter | 51/108 R |
| 2,943,423 | 7/1960 | Machovee | 51/218 R |

*Primary Examiner*—Harold D. Whitehead

*Attorney, Agent, or Firm*—Wheeler, House, Fuller & Hohenfeldt

[57] ABSTRACT

Disclosed herein is a method and apparatus for clamping and grinding cutting blades having an arcuate shank portion. The cutting blades are held in clamps having one fixed and one movable jaw, with the fixed jaw having a curved surface which interfits with the arcuate shank portion and fulcrums the blade about the oppositely located movable jaw to hold the blade against a rest. The jaws are mounted on a rotary work table.

9 Claims, 5 Drawing Figures

METHOD AND APPARATUS FOR GRINDING SMALL CUTTING BLADES

BACKGROUND OF THE INVENTION

The invention relates to a method and apparatus for clamping and grinding small cutting blades for a trimmer or the like. Because of the small size of the blades and non-planar and arcuate surfaces, known clamping techniques and procedures are not useable.

SUMMARY OF THE INVENTION

The cutting blades ground by the method and apparatus of the invention have a planar blade portion with opposite parallel surfaces, one of which is surface ground. A shank portion has two concentric arcuate surfaces which are employed for mounting and guiding the blade in a cutter blade mounting assembly (not a part of this invention). To support the cutting blades to facilitate grinding the cutting surface, a clamping technique is provided which includes fixed and movable jaws, with the fixed jaw having an arcuate surface complementary to the arcuate surfaces of the shank. The jaws are arranged so that when the shank of a blade is secured between the jaws, the grip or bite causes displacement of the blade about the lower jaw to press the blade against a work rest or support which is spaced from the jaws. The rest is located opposite the cutting surface to be ground and can be magnetic to assist in anchoring the blade. A radius on the rest surface which contacts the workpiece minimizes heat conductivity and hence warpage and distortion of the blade during the grinding process due to differential heating.

A method is provided for mounting and grinding the blades employing a rotary work table and missing work station to enable dressing of the grinding wheel while the workpieces are being changed on the work table.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
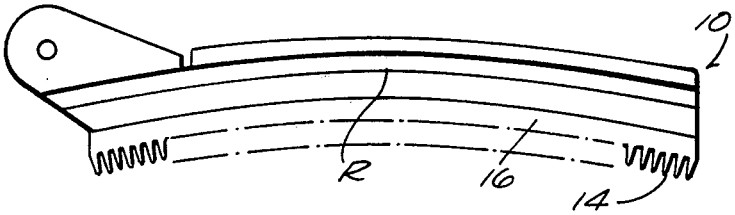
FIG. 1 is an enlarged view of a trimmer blade which is ground in accordance with the method of the invention.
Figure 2:
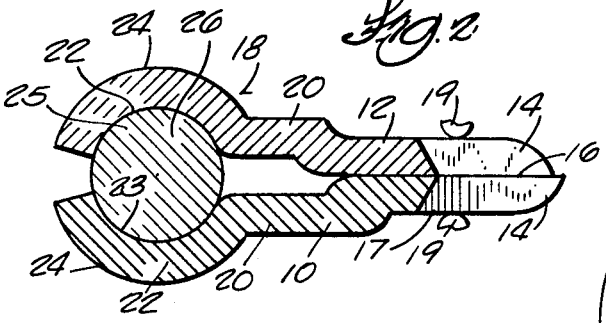
FIG. 2 is a greatly enlarged sectional view of two blades arranged in normal cutting relationship.
Figure 4:
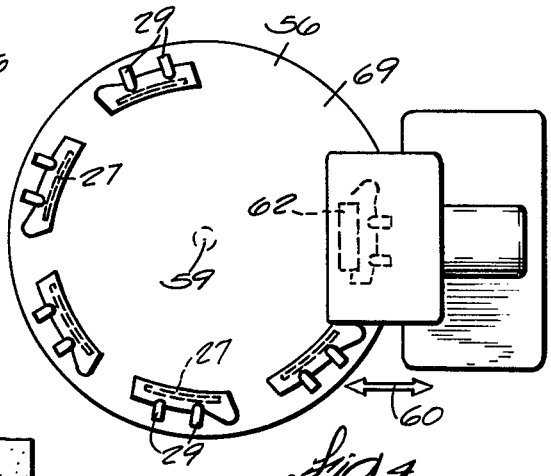
FIG. 4 is a diagrammatic plan view of grinding apparatus for grinding the trimmer blade surfaces in accordance with the invention.

In the drawings, FIG. 1 illustrates a cutting blade 10 which is used with a second blade 12, as shown in FIG. 2, to provide a reciprocating clipper cutting action. The blades are in right and left hand or allochiral relationship. The blades have a toothed cutting edge 14 and planar abutting cutting surfaces 16 which must be ground. Intimate contact between the surfaces 16 is required for good cutting action. Tolerances of 0.001 inches are desirable. The cutting blades also have shank portions 18 which include offset planar surface portions 20 and arcuate shank portions 22 having inner surfaces 23 concentric with outer arcuate surfaces 24 and provide an elongated curved groove or channel 25 having a radius R. In use, one of the blades is fixed and the other reciprocatable by (mechanism not shown). One or more ball bearings 26 fit in the channel 25 and guide blade movement in an arcuate path. The dimensional relationship between ground surface 16 and the spacing established by the cooperation of balls 26 and groove 25 is critical. The blades are pressed together by a resilient mount 19. The blades form no part of the invention but are the workpiece processed by the method and apparatus of the invention.

Because of the size of the blades, which may be less than three-fourths inch in width and the need to retain the relationship between ground faces 16 and the other surfaces, such as surface 23, conventional clamping techniques could not be employed to hold the blades during grinding. To solve this problem, we have devised a method of holding the blades between opposed jaws which positively position the blades on a work table and create a moment of force about the lower jaw to hold the blades 11, 12 against a fixed work support or rest which is located opposite the grinding wheel and beneath the surface 16, as subsequently described.

Figure 3:
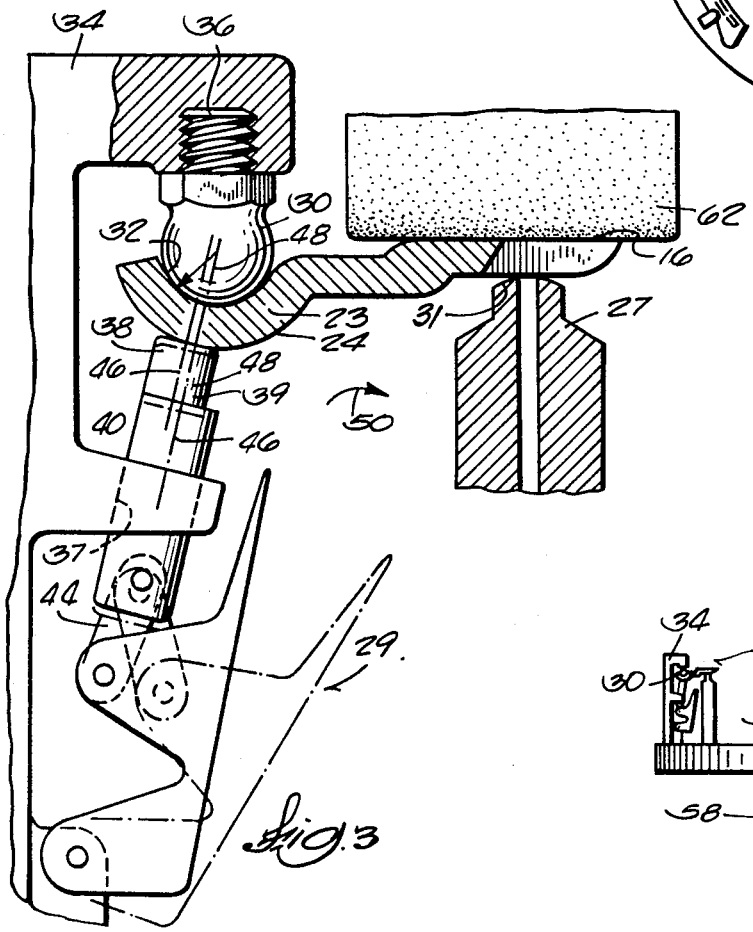
FIG. 3 is an enlarged side elevational view of a blade being clamped in accordance with the invention.

As illustrated in FIG. 3, a clamp 29 is provided which includes a reference surface in the form of a spherical fixed jaw 30 having a curved surface 32 complementary to the curvature of surface 23 and having the same radius as the balls 26. Hence the finished surface 16 will be in a plane having the desired relationship with respect to the axis of reciprocation of the blades and the center of the balls 26. The fixed jaw 30 is secured to a bracket 34 by a threaded connection 36. The movable jaw 39 has a pad 38 and is supported for axial movement in aperture 37 in arm 40. Means are provided to move the movable jaw. In the disclosed construction, the means comprises a toggle linkage and lock assembly 44 which is shown in full lines in a locking position (FIG. 3) and in dotted lines in an unlocked position. When the toggle linkage is in the locked full line position, the force centered on line 46 is offset or off center from the axis 48 of jaw 39 and causes a moment of force or tendency to displace the blade in the direction of arrow 50 to urge the blade against the rest or support 27. The rest 27 can be magnetic or of a vacuum containing design to assist in holding the workpiece against the rest 27. The rest 27 desirably has an arcuate surface or radius at 31 and also has a curve comparable to the blades to provide continuous support under the blades to minimize contact of the rest with blade surface 17 to reduce differential heating effects. With a broad based support, conduction of the heat from the blade adjacent the support can cause a temperature differential and warpage of the blade. If the blade is warped or distorted during grinding, the finished surface will not be planar. Two or more of the clamp pairs can be employed.

Figure 5:
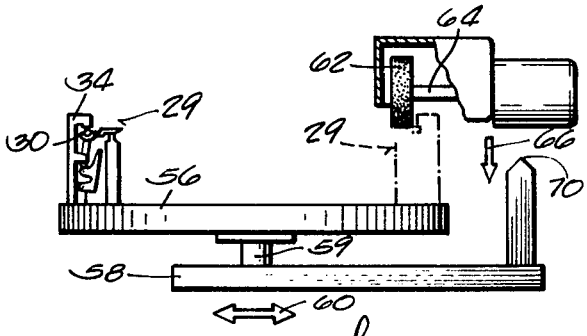
FIG. 5 is a diagrammatic side view of the apparatus shown in FIG. 4.

The mounting bracket 34 and the rest 27 are supported on a circular work table 56 (FIG. 5) which is rotatably supported on a saddle 58 for rotation about axis 59. The saddle moves in a horizontal feed direction indicated by the arrow 60 to bring the blade surfaces to be ground in contact with the rotary grinding wheel 62 which rotates about a horizontal axis 64. The grinding wheel is supported for vertical movement in the direction of arrow 66.

In the grinding process, the table 56 rotates and oscillates in direction 60 illustrated by arrow 60, distributing the wear of the grinding wheel. Upon completion of the grinding, table 56 indexes so that missing nest section 69 is rotatably located in line with grinding wheel 62 by means of hydraulic metering of the table feed about axis and a shot pin is arranged to stop the table motion in the proper position. When the feeding of the grinding is stopped, saddle 58 indexes to the extreme left position, placing wheel dressing stone 70 under the grinding wheel 62. Saddle 58 continues to oscillate wheel dressing tool 70, which is carried by saddle 58, under grinding wheel 62, which is then fed down in direction 66 by an amount necessary to compensate for wheel wear. When this dressing is complete, wheel 62 is raised in a direction opposite to 66 to a height which will be above the next workpiece load. The clamps are then reloaded and the cycle repeated, with wheel 62 being moved in direction 66 until a stop is reached which corresponds to the previous wheel dressing height.

What is claimed is:

1. A method of grinding planar cutting surfaces of cutting blades in which substantial portions are non-planar, the blades including a planar cutting portion and a shank and inside and outside concentric arcuate surfaces comprising the steps of providing a work table with a pair of clamping jaws for each of the cutting blades, including a movable jaw and a fixed jaw, and in which one of said jaws has a surface with a curvature complementary to the curvature of the arcuate blade shank portions, and means for releasably clamping the jaws against the arcuate shank surfaces, with the bite of the jaws creating a moment of force to fulcrum the blade portion about the contact point with one of said jaws and against a spaced work rest supported on the work table to expose the blade surface to be ground and rotating the work table while moving the table along a feed axis parallel to the axis of rotation of a rotary grinding wheel.

2. A method of holding and grinding a cutting blade having a planar surface to be ground and an arcuate shank portion and in which the blade is relatively small and difficult to grip comprising the steps of providing a clamp having opposed jaws, one of the jaws having a surface complementary to an arcuate clampable surface on the shank portion and said jaws gripping the arcuate portions off center to urge the blade portion which is opposite the blade portion to be ground against a rest and grinding the planar surface while said shank portion is gripped in the jaws of the clamps.

3. The method of claim 1 wherein said rest is magnetic.

4. Apparatus for clamping small cutting blades for machining and in which the cutting blades have a first portion to be ground and an annular groove defined by a wall having opposed second and third arcuate surfaces, comprising a work table, a pair of oppositely located jaws and a work rest supported on said table and spaced from said jaws, one of said jaws having a surface complementary to said second arcuate surface to positively position said first surface at a known position relative to the work table and the other of said jaws being movable, and means to support and move the movable jaw into engagement with said third surface to fulcrum the blade about said movable jaw to locate and hold said first portion against said rest.

5. Apparatus in accordance with claim 4 wherein said work rest is magnetic.

6. The method of any of claims 1, 2 or 3 wherein said work rest is shaped to minimize contact area with the blade to reduce heat conductivity from the blade.

7. The method of claim 1 in which said rotating work table has an omitted work station and including the step of indexing said rotary work table to the omitted work station and placing a wheel dressing station in its place under the grinding wheel.

8. Apparatus in accordance with claim 4 including a grinding wheel and wherein said jaw having the surface complementary to said second arcuate surface is on the same side of the blade as the surface being ground and the grinding wheel.

9. Apparatus in accordance with claim 4 including a grinding wheel and in which the relationship of the finished ground surface to the first arcuate surface is positively determined by the relationship of the arcuate surface of the clamp and the extent of downward travel of the grinding wheel.

* * * * *